US011786955B2

(12) United States Patent
List Clausen et al.

(10) Patent No.: US 11,786,955 B2
(45) Date of Patent: Oct. 17, 2023

(54) STRUT AND METHOD OF MANUFACTURING A STRUT

(71) Applicant: HYDRO EXTRUDED SOLUTIONS AS, Oslo (NO)

(72) Inventors: Edvin List Clausen, Aabenraa (DK); Carsten Pedersen, Tønder (DK)

(73) Assignee: HYDRO EXTRUDED SOLUTIONS AS, Oslo (NO)

( * ) Notice: Subject to any disclaimer, the term of this patent is extended or adjusted under 35 U.S.C. 154(b) by 22 days.

(21) Appl. No.: 17/045,316

(22) PCT Filed: Apr. 4, 2019

(86) PCT No.: PCT/EP2019/058518
§ 371 (c)(1),
(2) Date: Oct. 5, 2020

(87) PCT Pub. No.: WO2019/193099
PCT Pub. Date: Oct. 10, 2019

(65) Prior Publication Data

US 2021/0146424 A1 May 20, 2021

(30) Foreign Application Priority Data

Apr. 5, 2018 (SE) ..... 1850381-3

(51) Int. Cl.
*B21D 41/04* (2006.01)
*E04C 3/06* (2006.01)
*E04C 3/04* (2006.01)

(52) U.S. Cl.
CPC ..... *B21D 41/045* (2013.01); *E04C 3/06* (2013.01); *E04C 2003/0447* (2013.01)

(58) Field of Classification Search
CPC ..... B21D 41/00; B21D 41/02; B21D 41/04; B21D 41/026; B21D 41/028;
(Continued)

(56) References Cited

U.S. PATENT DOCUMENTS

2012/0054999 A1* 3/2012 Hsiang ..... B21D 19/08 29/428

FOREIGN PATENT DOCUMENTS

CN 1537740 A 10/2004
CN 2708222 Y 7/2005
(Continued)

OTHER PUBLICATIONS

Chinese Office Action (including English translation) issued in App. No. CN201980023996.9, dated Jul. 13, 2022, 18 pages.
(Continued)

*Primary Examiner* — Teresa M Ekiert
(74) *Attorney, Agent, or Firm* — Wenderoth, Lind & Ponack, L.L.P.

(57) ABSTRACT

A strut including an elongated beam portion and a connecting end portion. The elongated beam portion is a tubular structure having an external circumference, the connecting end portion is integral with the elongated beam portion, has a folded and flattened end portion of the tubular structure, and where diametrically opposite inward fold lines meet between flattened parts the end portion of the tubular structure. The resulting connecting end portion includes four material layers and the connecting end portion has a width transverse to a longitudinal centerline of the connecting end portion.

9 Claims, 4 Drawing Sheets

(58) Field of Classification Search
CPC .... B21D 41/045; B21D 39/08; B21D 35/002; B29C 57/10; B29C 53/086
See application file for complete search history.

(56) References Cited

FOREIGN PATENT DOCUMENTS

| | | | |
|---|---|---|---|
| CN | 102164760 | A | 8/2011 |
| CN | 105492708 | A | 4/2016 |
| DE | 19857589 | A1 | 7/1999 |
| DE | 102014014818 | A1 | 11/2015 |
| EP | 1277627 | A1 | 1/2003 |
| EP | 1566229 | A1 | 8/2005 |
| EP | 1566229 | A1 | 8/2005 |
| EP | 2338710 | A1 | 6/2011 |
| EP | 2338710 | A1 | 6/2011 |
| GB | 121352 | A | 12/1918 |
| GB | 287023 | A | 3/1928 |
| GB | 2321259 | A | 7/1998 |
| GB | 2321259 | A | 7/1998 |
| GB | 2354467 | A | 3/2001 |
| JP | S6186036 | A | 5/1986 |
| JP | H07237428 | A | 9/1995 |
| JP | 2001-62532 | | 3/2001 |
| TW | M251659 | U | 12/2004 |
| WO | 2004090369 | A1 | 10/2004 |

OTHER PUBLICATIONS

International Search Report for App. No. PCT/EP2019/058518, dated Jul. 15, 2019, 3 pages.
International Preliminary Report on Patentability for App. No. PCT/EP2019/058518, dated Jul. 21, 2020, 11 pages.
Office Action dated Jan. 5, 2023, in corresponding Brazilian Patent Application No. BR112020019723-8, with English translation.
Office Action dated Dec. 20, 2022 in Japanese Patent Application No. 2020-552413, with English-language translation.

* cited by examiner

Fig. 1
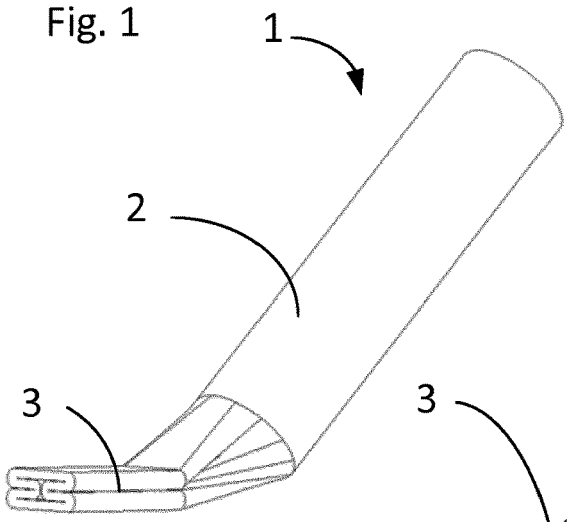
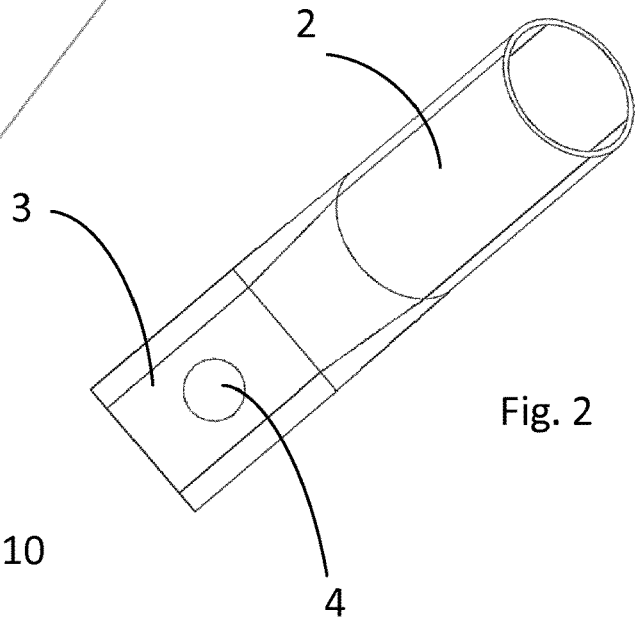
Fig. 2
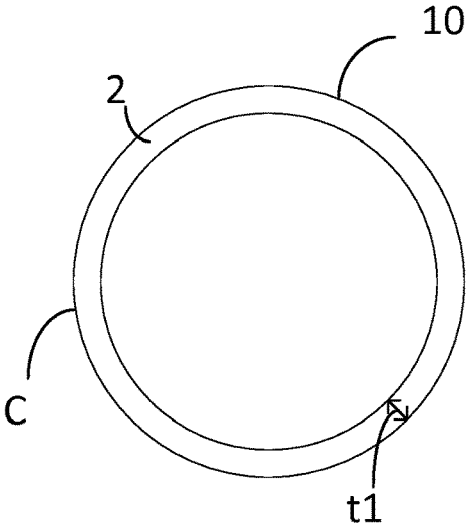
Fig. 3
Fig. 4
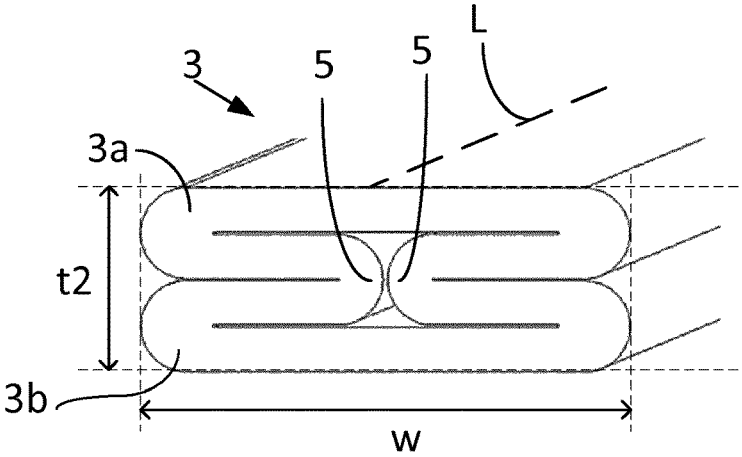

STRUT AND METHOD OF MANUFACTURING A STRUT

CROSS-REFERENCE TO RELATED APPLICATIONS

This application is a national stage application of International Application No. PCT/EP2019/058518, filed Apr. 4, 2019, which claims priority to SE 085038-3, filed Apr. 5, 2018, the disclosures of each of which are incorporated by references herein.

TECHNICAL FIELD

The present disclosure relates to a strut for automotive vehicles, and to a method of manufacturing such struts.

BACKGROUND

NVH (Noise, Vibration and Harshness) requirements to automotive vehicles require ridged car bodies. The use of tubular struts is a very efficient way to trim body stiffness and the use of such components has increased strongly over the last years. Struts may often be produced from aluminum extruded round or oval tubes, and may traditionally be straight and loaded in a push-pull mode to obtain maximum effect in a body, and be formed only at the connection area. The stiffness of the connection area may be important to the function of the strut. In order to increase the stiffness of the connection area in a strut, a local stiffener may be inserted at the end.

SUMMARY

The present disclosure describes an improved strut design, which has increased bending stiffness in the connection area, without using inserts.

A strut according to such an improved design may include an elongated beam portion and at least one connecting end portion, where the elongated beam portion may be a tubular structure having an external circumference C and the connecting end portion may be integral with the elongated beam portion. The connecting end portion may be comprised of a folded and flattened end portion of the tubular structure, in which diametrically opposite inward fold lines meet between flattened parts of the end portion of the tubular structure, so that the resulting connecting end portion comprises four material layers, and where the end portion of the tubular structure may have been cold-formed prior to, or after, being folded and flattened, so that the connecting end portion may have a width w in a direction transverse to a longitudinal centerline L of the connecting end portion, where w>C/4. The diametrically opposite inward fold lines may suitably meet approximately at the longitudinal centerline L of the connecting end portion.

The tubular structure of the elongated beam portion may have an average wall thickness tI and the connecting end portion may have a total thickness t2, where t2>3×tI. In one alternative, the tubular structure of the elongated beam portion may have an average wall thickness tI and the connecting end portion may have a total thickness t2, where t2=4×tI and w>C/4. In one alternative w>C/3, and if desired t2>4×tI.

The tubular structure of the strut may have a circular, flat oval, or oval cross-section, and may be an extruded aluminum tubular profile. Further, the at least one connecting end 10 portion of the strut may have an opening configured to receive a fastener.

The present disclosure also aims at providing a method of manufacturing a strut of the above mentioned improved design comprising the steps of providing a tubular element having an external circumference C and forming a connecting end portion at an end of the tubular element. The connecting end portion may be formed by folding and flattening a portion of the tubular 15 element, wherein the folding may be performed by deforming the material in said portion so as to form inward fold lines, and pushing them from diametrically opposite sides in a direction toward the center of the tubular element until they meet, and the flattening may be performed by pressing the thus folded portion toward the center of the tubular element, from opposite directions perpendicular to the direction of pushing), whereby an end portion comprising four material layers may be obtained, and wherein the method further comprises cold-forming of the end portion prior to, or after, the folding and flattening.

The folding may be performed by deforming the material in said portion so that the inward fold lines, meet approximately at a longitudinal centerline L of the resulting end portion.

The cold-forming of the end portion prior to, or after, the folding and flattening, may be performed so that the end portion attains a width w in a direction transverse to the longitudinal centerline L of the end portion which may be greater than one fourth of the external circumference C of the tubular element. The cold-forming may comprise pre-expansion of the end portion of the tubular element prior to folding and flattening, to increase its circumference. The pre-expansion may comprise increasing the circumference by 20-40%. The cold-forming may also comprise axial compression of the end portion of the tubular element prior to, or simultaneous with the pre-expansion of the circumference of the end portion of the tubular element.

The method may further comprise a step of forming an opening (4) configured to receive a fastener in the end portion, and the opening may be cold-formed after folding and flattening. The folded and flattened end portion may have a width wI in a direction transverse to the longitudinal centerline L, and may be cold-formed to increase the width to a width w2, where wI<w2, and may be w2>C/3.

BRIEF DESCRIPTION OF THE DRAWINGS

The invention may be better understood by references to the detailed description when considered in connection with the accompanying drawings. The components in the figures are not necessarily to scale, emphasis instead being placed upon illustrating the principles of the invention. In the figures, like reference numerals designate corresponding parts throughout the different views.

FIG. 1 is a schematic perspective side view of a strut of the present disclosure;

FIG. 2 is a schematic perspective top view of a strut of the present disclosure;

FIG. 3 schematically illustrates a cross-section of an example of a tubular structure or element from which the strut may be formed, and also illustrates the cross-section of an example of the elongated beam portion of the strut;

FIG. 4 is a schematic perspective side view of a strut showing the cross-section of the connecting end portion in more detail;

Figure 5:
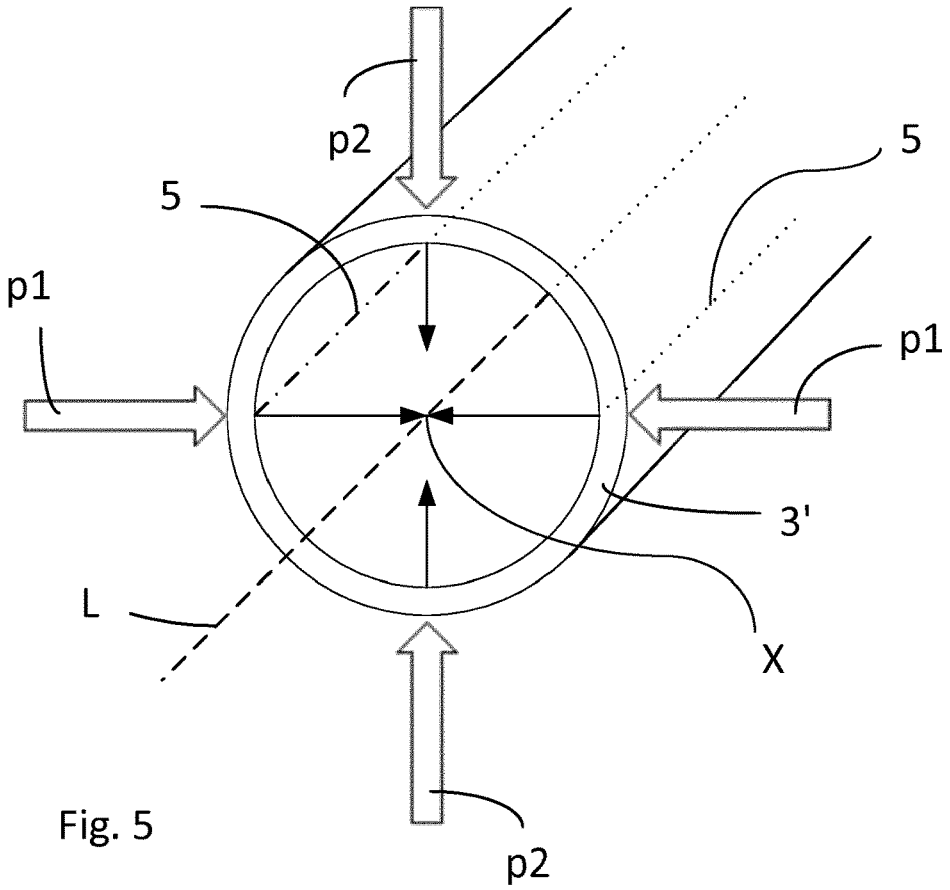
FIG. 5 schematically illustrates how the folding and flattening of an end portion of the tubular element may be performed.

Persons of ordinary skill in the art will appreciate that elements in the figures are illustrated for simplicity and clarity so not all connections and options have been shown to avoid obscuring the inventive aspects. For example, common but well-understood elements that are useful or necessary in a commercially feasible embodiment are not often depicted in order to facilitate a less obstructed view of these various embodiments of the present disclosure. It will be further appreciated that certain actions and/or steps may be described or depicted in a particular order of occurrence while those skilled in the art will understand that such specificity with respect to sequence is not actually required. It will also be understood that the terms and expressions used herein are to be defined with respect to their corresponding respective areas of inquiry and study except where specific meaning have otherwise been set forth herein.

DETAILED DESCRIPTION

In struts mounted in automotive structures, the connection areas may be subject to the highest local stresses. This may be particularly pronounced when the axis of connection area may be not in line with the axis of loading.

Conventional struts typically have connections areas for attachment to an automotive structure, where the connection area may be a flattened end portion of the strut. In order to improve stiffness in the connection area, inserts may be used, or the connection area may be formed with for example bent side edges to better take up kinetic forces. These ways may be often either too costly or not efficient enough.

Thus, the present disclosure aims at providing an improved strut design, which may have increased bending stiffness in the connection area. The strut of the present disclosure comprises an elongated beam portion and at least one connecting end portion, which may have an opening configured to receive a fastener. The strut may be connected at both ends to a body during use, and one or both connecting end portions may have the design and be manufactured in the way described herein. The elongated beam portion may be a tubular structure having an external circumference (C). The connecting end portion may be integral with the elongated beam portion and may be comprised of a folded and flattened end portion of the tubular structure, in which diametrically opposite inward fold lines meet between flattened parts of the end portion of the tubular structure, so that the resulting connecting end portion comprises four material layers. The end portion of the tubular structure may have been cold-formed prior to, or after, being folded and flattened, in order to obtain a certain desired width and/or thickness. Advantageously, the connecting end portion may have a width (w) in a direction transverse to a longitudinal centerline of the connecting end portion, which may be greater than one fourth of the external circumference of the tubular structure, i.e. $w>C/4$. This may be obtained e.g. by pre-expansion of the end portion before folding and flattening. In this context, the term "meet" may mean that the diametrically opposite inward fold lines may be brought close to each other in order to obtain a full four layered end portion, but they don't necessarily have to touch. The end portion may be folded asymmetrically or symmetrically. However, the diametrically opposite inward fold lines may meet approximately at a longitudinal centerline (L) of the connecting end portion, to give a desired symmetric stiffness in the folded area.

In the present description of the strut and the method of manufacturing it, the connecting end portion may be formed from a tubular element or tubular structure, which may have the same shape, dimensions and average wall thickness throughout it entire length. However, it may be contemplated that the shape, dimensions and average wall thickness tubular element or tubular structure may be different in the portion which may be to form the connecting end portion. If so, the external circumference and average wall thickness and any other detail of the tubular structure or element which may be relevant for the resulting end connecting portion refers to the portion of the tubular structure or element from which the end connecting portion may be formed.

In case no forming of the connecting end portion may have been performed, except from the folding and flattening, the thickness t2 of the end portion may be about four times the average wall thickness tI, and the width may be less than one fourth of the external circumference C of the tubular structure from which the connecting end portion may be formed, since some of the circumference may end up as giving the end portion its thickness. With a thickness $tI=0$, the width would be $w=C/4$, but since the thickness may be $tI>0$, the width may be $w<C/4$. The width (without any forming except the folding and flattening) may be expressed as $w=(C-0.6\times tI)/4$, based on the assumption that the folds have approximately semicircular cross sections. However, the connecting end portion of the tubular structure of the present disclosure may be cold-formed prior to, or after, being folding and flattening, so that the connecting end portion may have a width (w) in a direction transverse to a longitudinal centerline (L) of the connecting end portion, where $w>C/4$. Thus, without any cold forming in addition to the folding and flattening, the width may be $w=(C-0.6\times tI)/4$, and with cold forming the width may be greater. In some embodiments, the end portion may be cold formed in various ways to increase the width and/or the thickness thereof in order to improve the strength of the connecting end portion. In some embodiments, the more material that may be added to the cross sectional area within the connecting end portion, the higher local stiffness may be achieved. It may be discussed in more detail below, in connection with the description of the method, how this may be obtained.

Accordingly, the tubular structure of the elongated beam portion may have an average wall thickness tI and the connecting end portion may have a total thickness t2, where the 5 total thickness t2 of the connecting end portion may be equal to or greater than three times the average wall thickness tI, i.e. t2>3×tI, which may be obtained by cold-forming. This may allow the connection end portion to have a greater width that one fourth of the external circumference of the tubular structure, since some of the folded material may contribute to the width. The thickness t2 of the connecting end portion in measured in a direction perpendicular to the width 10 direction thereof. The term "average thickness" may refer to the fact that the tubular structure of the elongated beam portion may have different wall gauges in the periphery, but when folded into the connecting end portion all material comprised in the tube may contribute to the width and thickness of the connecting end portion.

In some embodiments, the connecting end portion may have a total thickness t2, which 15 may be approximately equal to four times the average wall thickness tI of the tubular structure of the elongated beam portion, and at the same time the width or the connecting end portion may be greater than one fourth of the external circumference of the tubular structure, i.e. t2=4×tI and w>C/4.

In an alternative the width of the connecting end portion may be equal to or greater than a third of the circumference of tubular structure, i.e. w>C/3, or the thickness t2 of the connecting end portion may be greater than four times the average wall thickness of the tubular structure, i.e. t2>4×tI.

The tubular structure strut may have a circular, flat oval, or oval cross-section, which has been shown to provide excellent load carrying properties. The tubular structure may be produced from a rolled and welded sheet, but may be an extruded aluminum tubular profile, which may allow for efficient manufacture of the tubular structure, and allows for the possibility of providing tubular structures have varying gauge over the periphery.

As mentioned above, a method of manufacturing a strut is also disclosed. The method may include providing a tubular element having an external circumference C and forming a connecting end portion at an end of the tubular element. The connecting end portion may be formed at an end of a tubular element, or it may be formed at an intermediate position along a tubular element, which may be then split in two parts after forming the connection end portion, so that two struts may be obtained in one step. Whenever the connecting end portion is mentioned in the below description, any one of these two alternative options for forming the connecting end portion may be encompassed.

In the present method, the connecting end portion may be formed by folding and flattening a portion of the tubular element, wherein the folding may be performed by deforming the material in said portion so as to form inward fold lines, and pushing them from diametrically opposite sides in a direction toward the center X of the tubular element until they meet, and the flattening 103 may be performed by pressing the thus folded portion toward the center X of the tubular element, from opposite directions perpendicular to the direction of pushing, whereby an end portion comprising four material layers may be obtained; and optionally an opening configured to receive a fastener may be formed 104 in the end portion.

The folding may be performed by deforming the material in the end portion so that the inward fold lines meet between flattened parts of the end portion of the tubular structure, which may be approximately at a longitudinal centerline (L) of the end portion. The term "meet" may mean that the diametrically opposite inward fold lines may be brought close to each other in order to obtain a full four layered end portion, but they do not necessarily have to touch. In some embodiments, they may be brought into contact with each other to give a symmetrical stiffness in the folded area.

The end portion may be folded asymmetrically so that one fold is larger than the other, and in some embodiments it may be folded such that only one side is pushed toward the diametrically opposite side of the tubular structure. However, in some embodiments, the diametrically opposite inward fold lines may meet approximately at a longitudinal centerline L of the connecting end portion, which may give a symmetric stiffness in the folded area.

As said above, the width of the connecting end portion in a direction transverse to the longitudinal centerline L may be slightly above one fourth of the external circumference of the tubular element from which the connecting end portion may be formed, and the thickness t2 of the end portion may be about four times the average wall thickness tI, unless no forming of the connecting end portion has been performed except from the folding and flattening. This may increase the stiffness with respect to bending loads as compared to a flattened two layer end connection.

In order to improve bending stiffness, in some embodiments, the method of manufacturing the strut may include one or more steps of cold-forming of the end portion, which may be performed prior to or after the folding and flattening of the end portion. Cold-forming may be performed at temperatures below 200 C, typically <100 C, and may improve material properties by cold deformation resulting in improved stiffness. In some embodiments, by means of cold-forming, material in the connecting end portion may be redistributed, so that it may attain a certain shape, width and thickness as will be explained in more detail below. The thickness t2 of the connecting end portion may be less than, equal to, or greater than about four times the average wall thickness tI of the tubular element from which the end connection end portion depending on the combinations of cold forming used when forming the end portion.

In some embodiments, the width of the connecting end portion may be greater than one fourth of the external circumference C of the tubular element, or greater than one third of the external circumference C, to allow sufficient space for a connecting fastener to be used for mounting the strut to an automotive structure. In some embodiments, one way of obtaining the increased width may be by cold-forming the end portion after folding and flattening, until the folded and flattened end portion, which may have an initial width wI in a direction transverse to the longitudinal centerline L, an may attain a width w2, which may be greater than the initial width wI (i.e. wI<w2), and, for example, may be greater than one third of the of the external circumference C of the tubular element (w2>C/3). The width w2 of cold-formed end connecting portion may be up to C/2.5.

The width of the connecting end portion may also be increased as compared to the width of an end portion which may have only been folded and flattened by performing a cold-forming prior to folding and flattening, which may comprise pre-expansion of the end portion of the tubular element to increase its circumference. By means of this step, the width may be increased to the same extent as if the cold-forming was performed after folding and flattening, and in addition it may be avoided that a narrow throat may be formed in the transition between the elongated beam portion and the connecting end portion, which may be the result of folding and flattening before cold-forming to an increased width. Thereby, bending stiffness may be improved. The pre-expansion may be performed by inserting an expansion mandrel into the tubular element, whereby the walls of the tubular element may be stretched and thinned. The mandrel may have a narrow section having a cross-sectional shape and size that may correspond to the initial interior of the tubular element, and a wide section having a cross-sectional shape and size corresponding to the interior of the pre-expanded tubular element, and a transition section between the narrow and wide sections, in which the shape and size may gradually change from the narrow to the wide section. The pre-expansion may comprise increasing the circumference by 20-40%.

The stiffness may be further improved by subjecting the tubular portion, which may become the connecting end portion, to a cold-forming step comprising axial compression of the end portion of the tubular element prior to, or simultaneous with the pre-expansion of the circumference of the end portion of the tubular element. The axial compression may be performed by using a mandrel having a forward section having a cross-sectional shape and size corresponding to the initial interior of the tubular element, and compressing section having a cross-sectional shape and size corresponding to the exterior of the tubular element, where the transition between the forward section and the compressing section may be immediate, so that the compressing section may comprise a contact surface which is substantially perpendicular to the longitudinal axis of the mandrel. In some embodiments, when inserted into the tubular element, the contact surface may abut with the end surface of the tubular element and an end section may be axially compressed due to the force exerted on the tubular element by the mandrel, and the wall thickness may consequently increase. As said above, in some embodiments, the axial compression and pre-expansion may also be performed in one step, and this may be performed by a mandrel having a shape and size, which may be a combination of the above described mandrels for pre-expansion and axial compression, i.e. including all of a narrow section, a wide section, a transition section, and a compression section, having a contact surface. In such embodiments, the compression section may be a separate component arranged circumferentially to the wide section, so that the narrow section, the transition section and the wide section may be inserted into the tubular element first to pre-expand the end section of the tubular element, and the thus pre-expanded end may be then axially compressed by the compression section in the same step. The tubular element may be clamped as suitable during pre-expansion and axial compression.

The connecting end portion may comprise an opening which may be configured to receive a fastener, which may facilitate mounting of the strut to an automotive structure. In some embodiments, the opening may be obtained by punching a hole in the formed end connection portion. However, in some embodiments, the opening may be formed by cold forming after folding and flattening. In this way, all material which may have originally been present in the tubular element from which the end connecting portion may have been formed may be maintained in the end connecting area and may be used to increase the width and/or thickness of the end connecting portion.

Embodiments of the strut and the method of manufacturing a strut will now be described in connections with the drawings.

FIGS. 1 and 2 show a portion of a strut 1 according to an embodiment of the present disclosure, with an elongated beam portion 2 and a connecting end portion 3 having an opening 4 configured to receive a fastener. The elongated beam portion 2 may be a tubular structure 10 having an external circumference C and an average wall thickness tI, as shown also in FIG. 3, and the connecting end portion 3 may be integral with the elongated beam portion 2 and may be comprised of a folded and flattened end portion of the tubular structure. In the folded and flattened end portion 3, diametrically opposite inward fold lines 5 may meet between flattened parts 3*a*, 3*b* of the end portion 3, so that the resulting connecting end portion 3 may comprise four material layers, as illustrated in FIG. 4. The end portion of the tubular structure may have been cold-formed prior to, or after, being folded and flattened, so that and the connecting end portion may have a width w in a direction transverse to a longitudinal centerline L of the connecting end portion, where w>C/4. As shown in FIG. 4, the diametrically opposite inward fold lines 5 may meet approximately at the longitudinal centerline L of the connecting end portion. The connecting end portion may have a total thickness t2, which may be t2>3×tI. In some embodiments, the connecting end portion 3 may have a total thickness t2, where t2=4×tI and w>C/4. In some cases the width may be w>C/3. The thickness t2 may be t2>4×tI.

Figure 6A:
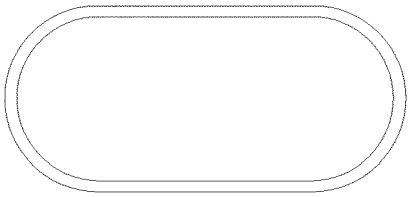
FIGS. 6*a* and 6*b* schematically illustrates examples of alternative suitable cross-sections of tubular structures or elements from which the strut may be formed.
Figure 6B:
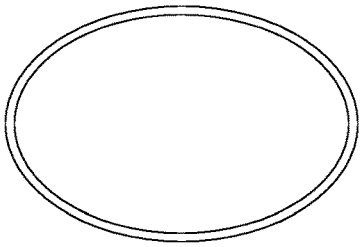

The tubular structure of the elongated beam and of the tubular element from which the end connecting portion is made may have a circular, flat oval, or oval cross-section, as shown in FIGS. 3, 6*a* and 6*b*, and may be an extruded aluminum tubular profile.

Figure 13:
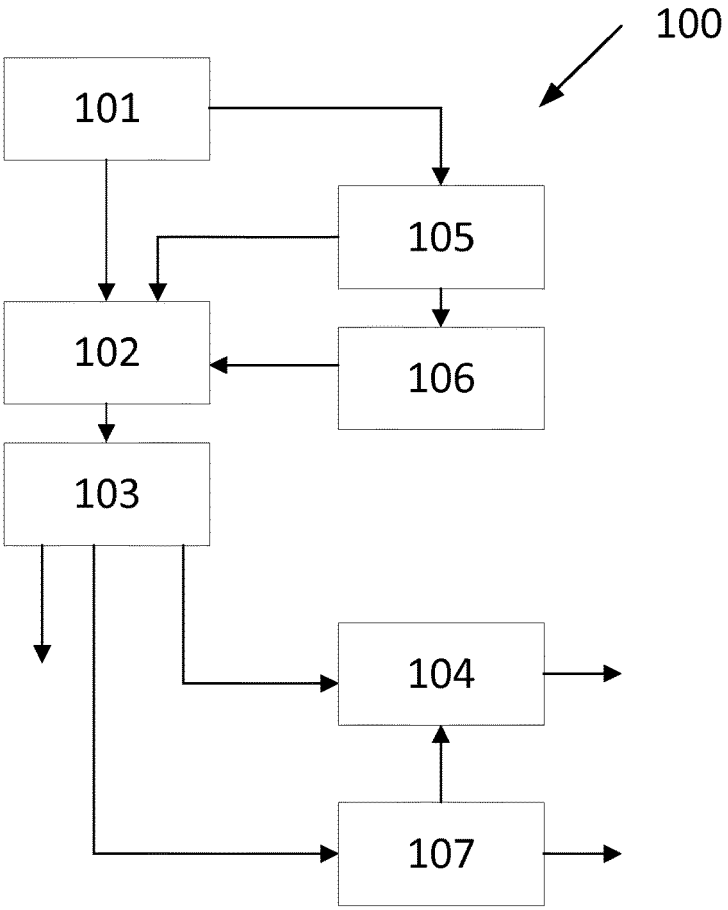
FIG. 13 is a diagram schematically illustrating a method of manufacturing a strut according to 5 the present disclosure.

The method 100 of manufacturing a strut 1 is schematically illustrated in FIG. 13. In some embodiments, the method may comprise the steps of providing 101 a tubular element 10 having an external circumference C and forming 102; 103 a connecting end portion 3 at an end of the tubular element 10 by folding and flattening a portion 3' of the tubular element 10, as illustrated in FIG. 5. The folding 102 may be performed by deforming the material in said portion 3' so as to form inward fold lines 5, and pushing them from diametrically opposite sides in a direction pi toward the center X of the tubular element until they meet, and the flattening 103 may be performed by pressing the thus folded portion 3' toward the center X of the tubular element, from opposite directions p2 perpendicular to the direction of pushing pi, whereby an end portion 3 comprising four material layers may be obtained. In some embodiments, the folding 102 may be performed by deforming the material in said portion 3' so that the inward fold lines 5 meet approximately at a longitudinal centerline L of the resulting end portion. The method may also comprise forming 104 an opening 4 in the end portion, which may be configured to receive a fastener. In some embodiments, the method may further comprise cold-forming of the end portion prior to, or after, the folding 102 and flattening 103, so that the end portion may attain a width w in a direction transverse to the longitudinal centerline L of the end portion which may be greater than one fourth of the external circumference C of the tubular element. In particular, the method may comprise cold-forming in the form of pre-expansion 106 of the end portion of the tubular element prior to folding 102 and flattening 103, to increase its circumference, and this may be combined with cold-forming in the form of axial compression 105 of the end portion of the tubular element prior to, or simultaneous with the pre-expansion 106 of the circumference of the end portion of the tubular element.

Figure 7:
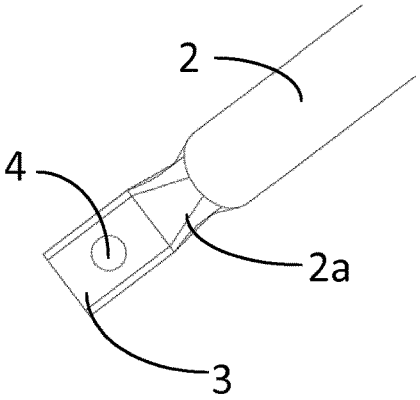
FIG. 7 is a schematic perspective top view of a strut of the present disclosure.

FIG. 7 shows an embodiment of the strut in which the end portion 3 may have been folded 102 and flattened 103 and thereafter cold-formed 107 to an increased width to obtain a wider end section. This way of forming the end connection portion may give a throat 2*a* in the transition between the elongated beam portion 3 and the connecting end portion 3.

Figure 8:
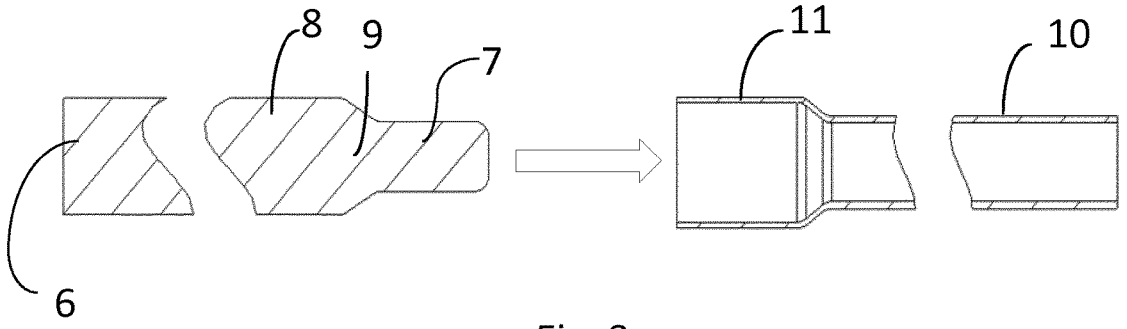
FIG. 8 schematically illustrates pre-expansion of the end portion of the tubular element.

As illustrated in FIG. 8, the pre-expansion 106 may be performed by inserting a pre-expansion mandrel 6 into the tubular element to stretch and thin the walls of the tubular element 10. In such embodiments, the mandrel may have a narrow section 7 having a cross-sectional shape and size corresponding to the initial interior of the tubular element 10, and a wide section 8 having a cross-sectional shape and size corresponding to the interior of the pre-expanded tubular element 11, and a transition section 9 between the narrow and wide mandrel sections, and the pre-expansion mandrel 6 may be dimensioned to increase the circumference of the tubular element 10 by 20-40%.

Figure 9:
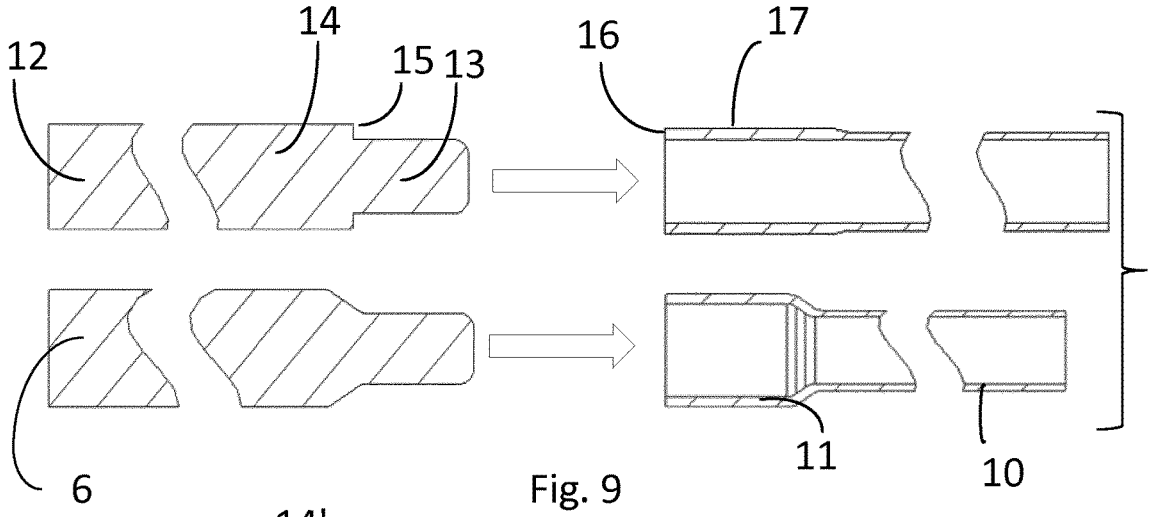
FIG. 9 schematically illustrates axial compression followed by pre-expansion of the end portion of the tubular element.

FIG. 9 shows how axial compression 105 may be performed by using a compression mandrel 12 having a forward section 13 having a cross-sectional shape and size corresponding to the initial interior of the tubular element 10, and compressing section 14 having a cross-sectional shape and size corresponding to the exterior of the tubular element, where the transition between the forward section 13 and the compressing section 14 may be immediate, so that the compressing section 14 may comprise a contact surface 15 which may be substantially perpendicular to the longitudinal axis of the compression mandrel. When inserted into the tubular element, the contact surface 15 may be abut with the end surface 16 of the tubular element and the end section 17 may be axially compressed due to the force exerted on the tubular element 10 by the compression mandrel 12, and the wall thickness of the end section 17 may consequently increase.

Figure 10:
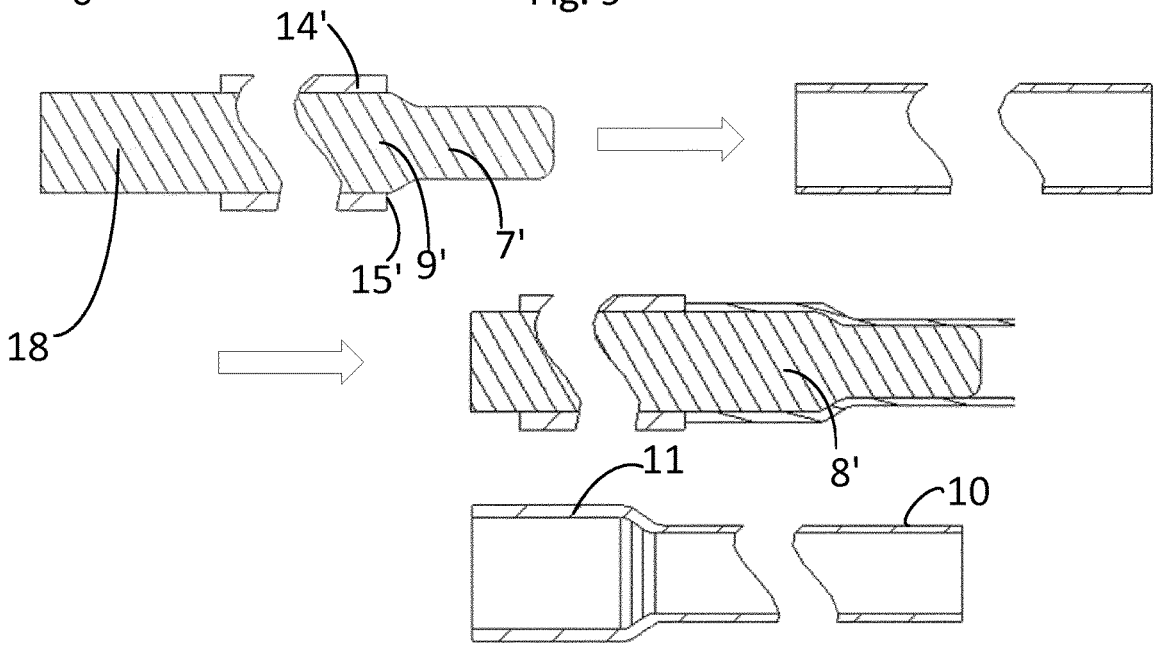
FIG. 10 schematically illustrates combined axial compression and pre-expansion of the end portion of the tubular element.

FIG. 10 shows how the axial compression 105 and pre-expansion 106 may be performed in one step by using a combined pre-expansion and compression mandrel 18 having a shape and size, which may be a combination of the above described pre-expansion mandrel 6 and the compression mandrel 12, so that it may include a narrow section 7', a wide section 8', a transition section 9', and a compression section 14', having a contact surface 15'. The compression section 14' may be a separate component arranged circumferentially to the wide section 8', and axially compresses the end of the tubular element after pre-expansion but in the same step.

Figure 11:
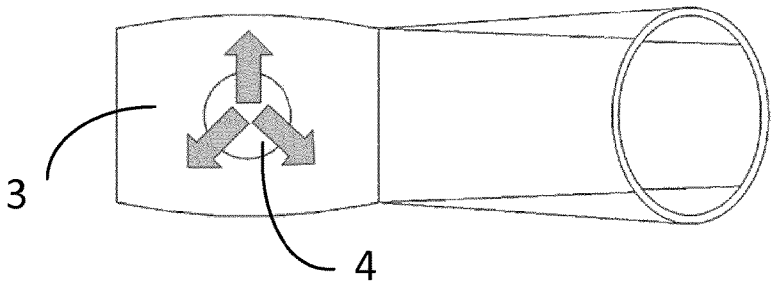
FIG. 11 schematically illustrates cold forming of an opening which is configured to receive a fastener.

FIG. 11 illustrates how the material of the end portion may be redistributed when the opening 4 is cold-formed 104 after folding 102 and flattening 103. In this way, the material which was originally located in the position of the opening may contribute to greater width and/or thickness of the final connecting end portion as desired.

Figure 12:
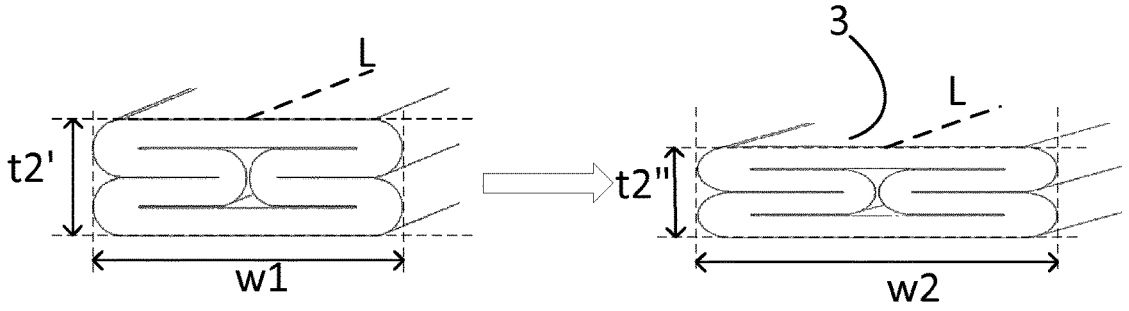
FIG. 12 schematically illustrates cold forming of the end portion after folding and flattening.

FIG. 12 shows an example of cold forming 107 the end portion after folding 102 and flattening 103 to increase the width in a direction transverse to the longitudinal centerline L. Directly after folding and flattening, the end portion may have an initial width wI and thickness t2' and may be cold formed 107 to a final width w2 and thickness t2". In some embodiments, the final width w2 may be greater than one third of the initial external circumference of the tubular element. In some embodiments, the final thickness t2" may less than the initial thickness t2' in the shown example, but may be equal to or greater than the initial thickness t2' depending on the combinations of cold forming used when forming the end connecting portion.

The figures depict preferred embodiments for purposes of illustration only. One skilled in the art will readily recognize from the following discussion that alternative embodiments of the structures and methods illustrated herein may be employed without departing from the principles described herein.

Upon reading this disclosure, those of skill in the art will appreciate still additional alternative structural and functional designs for the systems and methods described herein through the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the systems and methods disclosed herein without departing from the spirit and scope defined in any appended claims.

The invention claimed is:

1. A method of manufacturing a strut, the method comprising:

providing a tubular element having an external circumference (C);

forming a connecting end portion at the end of the tubular element by folding and flattening an end of the tubular element, wherein:

the folding is performed by deforming the material in the end so as to form inward fold lines, and pushing the inward fold lines from diametrically opposite sides of the end of the tubular element in a direction toward a center of the tubular element until fold lines meet, and the flattening is performed by pressing the folded portion toward the center of the tubular element from opposite directions perpendicular to the direction of pushing, thereby forming the connecting end portion with four material layers, and cold-forming of the connecting end portion prior to the folding and flattening, wherein the cold-forming includes pre-expansion of the end of the tubular element.

2. The method of claim 1, wherein the folding is performed by deforming the material in the connecting end portion such that the inward fold lines meet approximately at a longitudinal centerline of the resulting end portion.

3. The method of claim 1, wherein the cold-forming of the end portion is performed so that the connecting end portion attains a width (w) in a direction transverse to a longitudinal centerline of the end portion which is greater than one fourth of the external circumference (C) of the tubular element.

4. The method of claim 1, wherein the pre-expansion comprises increasing the circumference by between 20 and 40%.

5. The method of claim 1, wherein the cold-forming comprises axial compression of the connecting end portion either prior to or simultaneous with the pre-expansion of the circumference of the connecting end portion.

6. The method of claim 1 further comprising forming an opening configured to receive a fastener in the end portion.

7. The method of claim 6, wherein the opening is cold-formed after folding and flattening.

8. The method of claim 1, wherein the folded and flattened connecting end portion has a width (w1) in a direction transverse to the longitudinal centerline (L), and the cold-forming increases the width to a width (w2), wherein w1 and w2 are defined such that: $w1<w2$.

9. The method of claim 1, wherein the folded and flattened connecting end portion has a width (w1) in a direction transverse to the longitudinal centerline (L), and the cold-forming increases the width to a width (w2), wherein w2 is defined such that: $w2>C/3$, wherein C is the external circumference (C).

* * * * *